US010258207B2

(12) United States Patent
Stewen et al.

(10) Patent No.: US 10,258,207 B2
(45) Date of Patent: Apr. 16, 2019

(54) PORTABLE HARD SURFACE CLEANING APPLIANCE

(71) Applicant: Alfred Kärcher GmbH & Co. KG, Winnenden (DE)

(72) Inventors: Christian Stewen, Marbach (DE); Anne Oberländer, Waiblingen (DE); Sandra Bartel, Untergruppenbach (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 617 days.

(21) Appl. No.: 14/996,652

(22) Filed: Jan. 15, 2016

(65) Prior Publication Data

US 2016/0128528 A1 May 12, 2016

Related U.S. Application Data

(63) Continuation of application No. PCT/EP2013/065247, filed on Jul. 18, 2013.

(51) Int. Cl.

| | |
|---|---|
| ***A47L 5/24*** | (2006.01) |
| ***A47L 11/40*** | (2006.01) |
| ***A47L 1/05*** | (2006.01) |
| *A47L 9/06* | (2006.01) |

(52) U.S. Cl.

CPC ..... *A47L 5/24* (2013.01); *A47L 1/05* (2013.01); *A47L 9/06* (2013.01); *A47L 11/40* (2013.01)

(58) Field of Classification Search

CPC . A47L 7/00; A47L 9/06; A47L 7/0028; A47L 5/24

See application file for complete search history.

(56) References Cited

U.S. PATENT DOCUMENTS

| | | | | |
|---|---|---|---|---|
| 7,159,275 | B2 | 1/2007 | Chang | |
| 9,021,654 | B2 * | 5/2015 | Fischer | A47L 1/05 15/320 |
| 2002/0073504 | A1 * | 6/2002 | Hall | A47L 1/08 15/320 |

FOREIGN PATENT DOCUMENTS

| | | |
|---|---|---|
| CN | 102835929 | 12/2012 |
| EP | 2 227 126 | 9/2010 |
| EP | 2 230 980 | 9/2010 |
| EP | 2 237 711 | 10/2010 |

(Continued)

*Primary Examiner* — Michael Jennings

(74) *Attorney, Agent, or Firm* — Womble Bond Dickinson (US) LLP

(57) ABSTRACT

A portable hard surface cleaning appliance includes a suction nozzle with a suction opening on which at least one drawing-off lip is arranged, a suction unit in flow connection with the suction nozzle for sucking up a liquid-air mixture from the suction opening, a separation chamber arranged between the suction nozzle and the suction unit and having a separation device arranged within for separating liquid from the liquid-air mixture, and a tank accommodating compartment in which a dirty liquid tank for receiving the separated liquid is releasably held. The tank accommodating compartment includes at least one supporting element engaged under a lower tank section of the dirty liquid tank, and at least one holding element releasably connectable to an upper tank section of the dirty liquid tank. The portable hard surface cleaning appliance includes two holding elements which receive between them the upper tank section of the dirty liquid tank.

22 Claims, 7 Drawing Sheets

(56) References Cited

FOREIGN PATENT DOCUMENTS

| | | |
|---|---|---|
| EP | 2 614 760 | 7/2013 |
| JP | 3108311 | 4/2005 |

* cited by examiner

PORTABLE HARD SURFACE CLEANING APPLIANCE

CROSS-REFERENCE TO RELATED APPLICATIONS

This application is a continuation of international application number PCT/EP2013/065247 filed on Jul. 18, 2013, which is incorporated herein by reference in its entirety and for all purposes.

BACKGROUND OF THE INVENTION

The invention relates to a portable hard surface cleaning appliance for drawing off and sucking up liquid from a hard surface, in particular, from a window pane, comprising a suction nozzle with a suction opening on which at least one drawing-off lip is arranged, a suction unit which is in flow connection with the suction nozzle for sucking up a liquid-air mixture from the suction opening, a separation chamber which is positioned in the flow path between the suction nozzle and the suction unit and in which a separation device is arranged for separating liquid from the liquid-air mixture, and a tank accommodating compartment in which a dirty liquid tank for receiving the liquid separated off in the separation chamber is releasably held, the tank accommodating compartment comprising at least one supporting element and at least one holding element, the at least one supporting element engaging under a lower tank section of the dirty liquid tank and the at least one holding element being releasably connectable to an upper tank section of the dirty liquid tank.

Such a portable hard surface cleaning appliance is known, for example, from EP 2 237 711 B1 and also from EP 2 230 980 B1 and EP 2 227 126 B1. With this portable hard surface cleaning appliance, a hard surface, in particular, a window pane can be cleaned. With the at least one drawing-off lip, the portable hard surface cleaning appliance can be moved along the hard surface in the manner of a manual squeegee so that liquid can be drawn off from the hard surface. The liquid collects at a suction opening of a suction nozzle of the portable hard surface cleaning appliance and can be sucked up from the suction opening and transferred to a dirty liquid tank. For this purpose, the portable hard surface cleaning appliance comprises a suction unit which is in flow connection with the suction nozzle. By means of the suction unit, a suction flow can be generated in the area of the suction opening, under the effect of which a mixture of liquid and air can be sucked in via the suction opening.

A separation chamber is positioned in the flow path between the suction nozzle and the suction unit. Arranged in the separation chamber is a separation device by means of which liquid can be separated off from the liquid-air mixture. The liquid can then be collected in the dirty liquid tank, which is releasably held in a tank accommodating compartment. The sucked-in air can be discharged by the suction unit to the environment.

The dirty liquid tank is fixed in the tank accommodating compartment by means of supporting and holding elements of the tank accommodating compartment. At least one supporting element engages under a lower tank section of the dirty liquid tank, and an upper tank section of the dirty liquid tank can be releasably connected to the tank accommodating compartment by means of at least one holding element. This makes it possible for the user to remove the dirty liquid tank from the tank accommodating compartment, as required, and to then insert the dirty liquid tank into the tank accommodating compartment again. For example, if the user wishes to empty the dirty liquid tank, it can be removed and inserted.

Portable hard surface cleaning appliances of the kind mentioned at the outset have proven their worth in practice. Holding elements of the tank accommodating compartment usually engage over the upper tank section of the dirty liquid tank, so that the dirty liquid tank inserted into the tank accommodating compartment assumes a position between a supporting element arranged at the lower end of the tank accommodating compartment and the holding elements arranged at the upper end of the tank accommodating compartment. This requires a high dimensional accuracy of the dirty liquid tank and so manufacture of the hard surface cleaning appliance involves considerable costs.

The object of the present invention is therefore to further develop a portable hard surface cleaning appliance of the generic kind so that it can be manufactured more cost-effectively.

SUMMARY OF THE INVENTION

This object is accomplished, in accordance with the invention, with a portable hard surface cleaning appliance of the kind mentioned at the outset in that the hard surface cleaning appliance comprises two holding elements which receive between them the upper tank section of the dirty liquid tank.

In the portable hard surface cleaning appliance in accordance with the invention, the dirty liquid tank is fixed in the tank accommodating compartment by at least one supporting element of the tank accommodating compartment engaging under the dirty liquid tank and two holding elements receiving between them an upper tank section of the dirty liquid tank. Such a configuration has the advantage that the requirements for the dimensional accuracy of the dirty liquid tank can be kept relatively low. It must be ensured that the width of the dirty liquid tank in its upper tank section corresponds to the distance between the two holding elements. This requirement can be met in a relatively simple way. For example, it may be provided that the dirty liquid tank forms a plastic part produced in a blow molding process. In contrast thereto, the tank accommodating compartment can be produced as a one-part or multi-part, in particular, two-part plastic molded part in an injection molding process, with the distance between the two holding elements corresponding to the width of the dirty liquid tank in the upper tank section. This requirement can be met, in particular, in the injection molding process with narrow dimensional tolerances in a cost-effective manner.

It is advantageous for the portable hard surface cleaning appliance to comprise a base part in which the suction unit is arranged.

The base part preferably forms the tank accommodating compartment.

In an advantageous embodiment, the portable hard surface cleaning appliance comprises a separation part in which the separation chamber is arranged.

It is expedient for the separation part to be releasably connected to the base part.

It may be provided that the suction nozzle is releasably connected to the separation part.

It is expedient, when the hard surface cleaning appliance is vertically aligned, for the lower tank section of the dirty liquid tank to be insertable in the vertical direction into a supporting area of the tank accommodating compartment, and by pivoting the dirty liquid tank about a horizontal pivot axis, for the upper tank section to then be pivotable into a holding position in which the upper tank section is positioned between the two holding elements. This facilitates insertion of the dirty liquid tank into and removal of the dirty liquid tank from the tank accommodating compartment.

The two holding elements are expediently of elastically deformable configuration.

It is particularly advantageous for the upper tank section to be releasably latchable to the two holding elements.

It may, for example, be provided that first latching elements are arranged on the upper tank section on outer sides of the dirty liquid tank that face away from each other and second latching elements arranged on the holding elements are engageable behind the first latching elements.

The first latching elements may, for example, be configured in the form of recesses arranged at the upper end of the dirty liquid tank, behind which latching projections of complementary configuration to the recesses can engage when the dirty liquid tank is inserted into the tank accommodating compartment. For this purpose, the holding elements can form the corresponding latching projections.

The two holding elements are preferably configured as holding arms.

In an advantageous configuration of the invention, the holding arms are formed on side walls of the tank accommodating compartment.

To make it easier for the user to remove the dirty liquid tank from the tank accommodating compartment, the dirty liquid tank in an advantageous configuration protrudes at the sides from the tank accommodating compartment below the holding arms. The user has the possibility of gripping the dirty liquid tank at the tank areas protruding at the sides from the tank accommodating compartment and so he can easily remove the dirty liquid tank from the tank accommodating compartment and insert the dirty liquid tank into the tank accommodating compartment.

The tank areas protruding at the sides from the tank accommodating compartment may, for example, be of rib-like or strip-like configuration.

It is particularly advantageous for the tank accommodating compartment to have a rear wall against which the dirty liquid tank lies and which has at least one through-opening. The provision of at least one through-opening makes it possible to reduce the weight of the base part, and this, in turn, facilitates handling of the portable hard surface cleaning appliance. In addition, the amount of material for manufacturing the hard surface cleaning appliance can be reduced by the provision of at least one through-opening in the rear wall of the tank accommodating compartment and so the hard surface cleaning appliance can be manufactured particularly cost-effectively.

In an advantageous configuration of the invention, the dirty liquid tank extends into at least one through-opening in the rear wall. For this purpose, the dirty liquid tank can have on its rear side facing the rear wall of the tank accommodating compartment at least one projecting area, the contour of which matches the contour of a through-opening in the rear wall. The projecting area can extend into the through-opening and reinforces the fixing of the dirty liquid tank in the tank accommodating compartment.

In an advantageous embodiment of the invention, the hard surface cleaning appliance comprises a grip, and arranged between the grip and the rear wall of the tank accommodating compartment is a grip opening into which at least one through-opening of the rear wall opens. The user can grasp the grip of the base part, and in doing so he reaches with his fingers through the grip opening between the rear wall of the tank accommodating compartment and the grip. The dirty liquid tank inserted in the tank accommodating compartment is accessible to the user in the area of the grip opening via the at least one through-opening in the rear wall. This makes it possible for the user to push the dirty liquid tank forwards at the though-opening in the rear wall. This facilitates removal of the dirty liquid tank from the tank accommodating compartment.

At least one through-opening in the rear wall of the tank accommodating compartment expediently extends into an area which is arranged between the two holding elements. The user can thereby push the dirty liquid tank forwards in the area between the two holding elements via the through-opening in the rear wall in order to release the mechanical connection between the holding elements and the dirty liquid tank. Removal of the dirty liquid tank from the tank accommodating compartment is therefore particularly easy.

As mentioned above, the dirty liquid tank collects the liquid separated off in the separation chamber. In a particularly preferred configuration, the portable hard surface cleaning appliance in accordance with the invention comprises a filling device for filling the dirty liquid tank with the liquid separated off in the separation chamber, the filling device having a holding member which is positionable on the upper side of the dirty liquid tank and on which is held a filling channel which extends into the dirty liquid tank via a filler opening of the dirty liquid tank, the holding member being clampable between the separation chamber and the dirty liquid tank.

The dirty liquid tank can be filled with the liquid separated off in the separation chamber via the filling device. The separated-off liquid enters the dirty liquid tank via the filling channel. The filling channel is held on a holding member which can be clamped between the separation chamber and the dirty liquid tank. This simplifies the constructional design of the hard surface cleaning appliance and reduces its manufacturing costs.

It is advantageous for guide elements insertable in each other in the vertical direction to be arranged on the upper side of the dirty liquid tank and on the holding member. The guide elements facilitate the positioning of the holding member on the dirty liquid tank, with the filling channel extending into the dirty liquid tank.

The guide elements may, for example, be in the form of guide pins and guide receptacles of complementary configuration to these.

It is particularly advantageous for the guide elements arranged on the upper side of the dirty liquid tank to be configured as guide pins which are arranged at both sides of a filler opening of the dirty liquid tank.

In an advantageous embodiment of the invention, the dirty liquid tank comprises a collar which is surrounded by a holding plate, and a closing plug for closing a drain opening of the dirty liquid tank is fixed to the holding plate. With such a configuration, the user has the possibility of emptying the dirty liquid tank via a drain opening which can be closed by means of a closing plug. To prevent the closing plug from getting lost, it is held on a holding plate which surrounds a collar of the dirty liquid tank.

The closing plug preferably forms in combination with the holding plate a one-part plastic molded part.

It is expedient for the holding plate to be clamped between the holding member and the dirty liquid tank.

As mentioned above, it is expedient for guide elements which interact with corresponding guide elements of the holding member of the filling device to be arranged on the upper side of the dirty liquid tank. In this connection, it is advantageous for the holding plate to be releasably connectable to the guide elements. The holding plate may, for example, have openings through which the guide elements extend.

In a preferred configuration, the holding member is of plate-shaped configuration. This imparts high mechanical stability to the filling device.

It is particularly expedient for the holding member to be of wedge-shaped configuration.

The filling device preferably comprises in addition to the filling channel a venting channel via which air can escape from the dirty liquid tank into the separation chamber when filling liquid into the dirty liquid tank.

The venting channel expediently extends parallel to the filling channel.

It is advantageous for the venting channel to protrude beyond the free end of the filling channel that faces the separation chamber.

The hard surface cleaning appliance in accordance with the invention preferably forms a portable window cleaning appliance.

The following description of an advantageous embodiment of the invention will serve for further explanation in conjunction with the drawings.

DETAILED DESCRIPTION OF THE INVENTION

Figure 1:
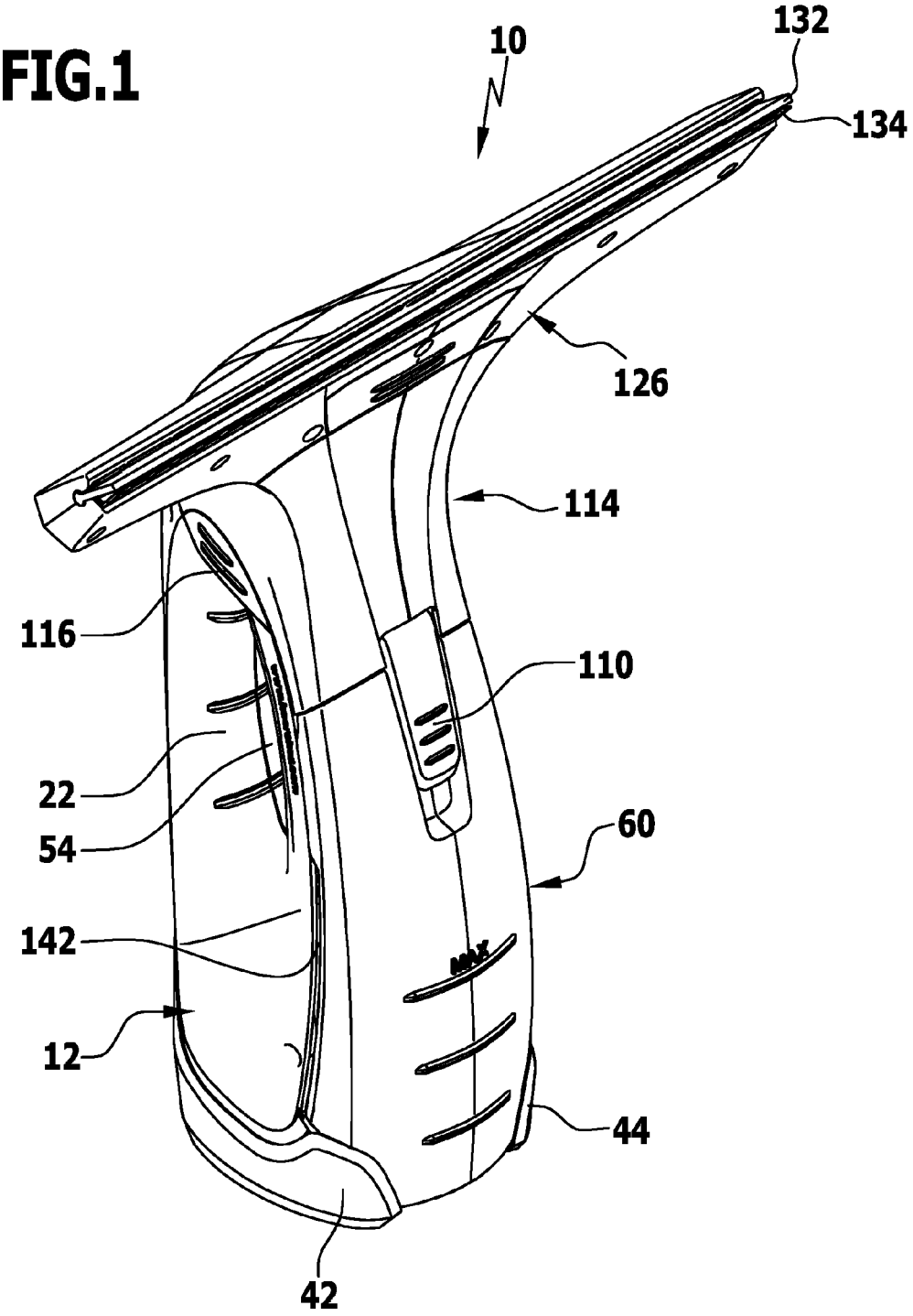
FIG. 1: shows a perspective representation of a portable hard surface cleaning appliance.

An advantageous embodiment of a portable hard surface cleaning appliance in accordance with the invention, denoted in its entirety by reference numeral 10, is shown schematically in the drawings. Liquid can be drawn off and sucked up from a hard surface, in particular, from a window pane by means of the portable hard surface cleaning appliance 10. The hard surface cleaning appliance 10 can be moved in the manner of a manual window squeegee along the hard surface by the user. The portable hard surface cleaning appliance in accordance with the invention therefore forms a window cleaning appliance.

Figure 5:
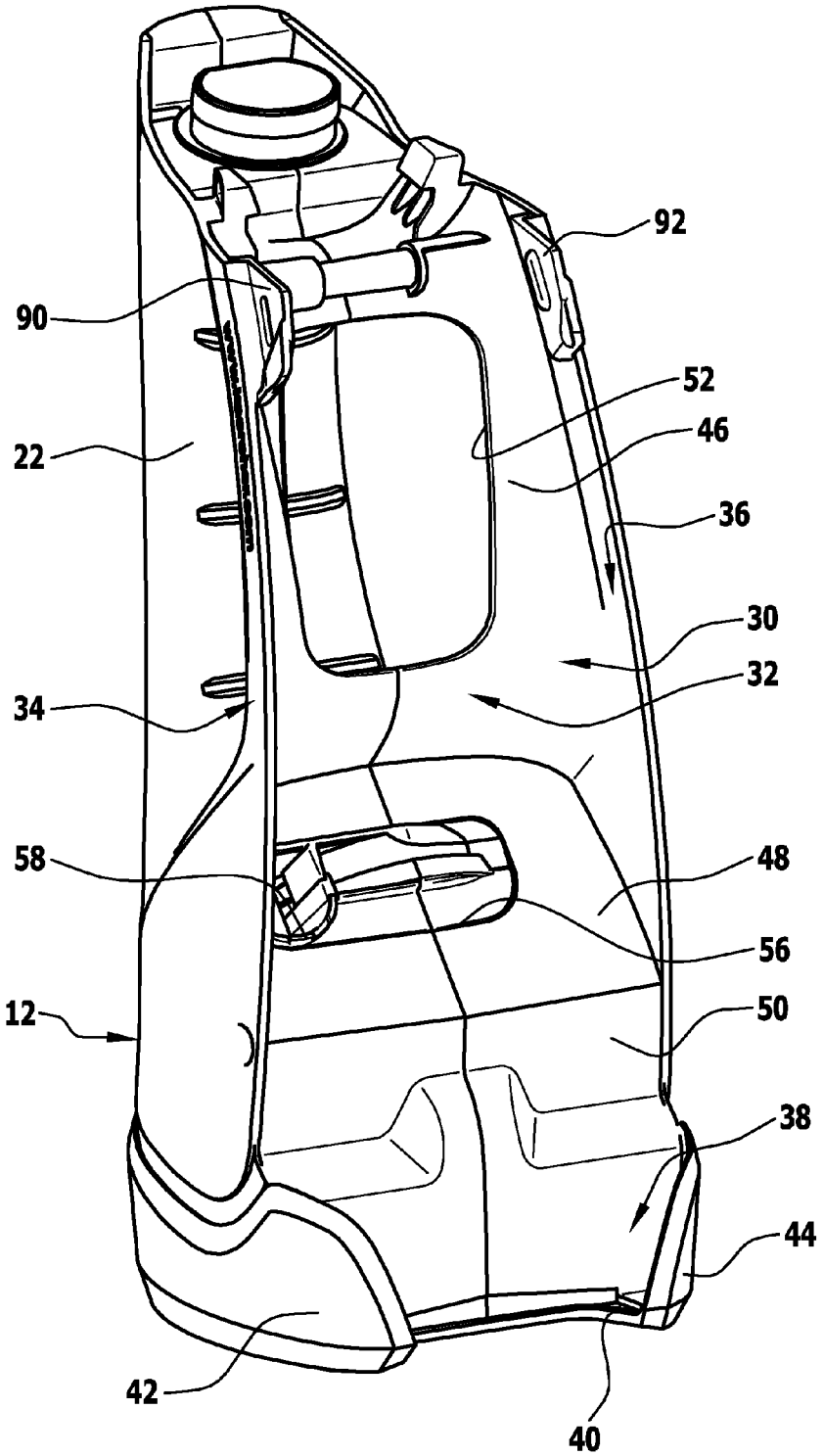
FIG. 5: shows a perspective representation of the base part from FIG. 3 without the dirty liquid tank.
Figure 6:
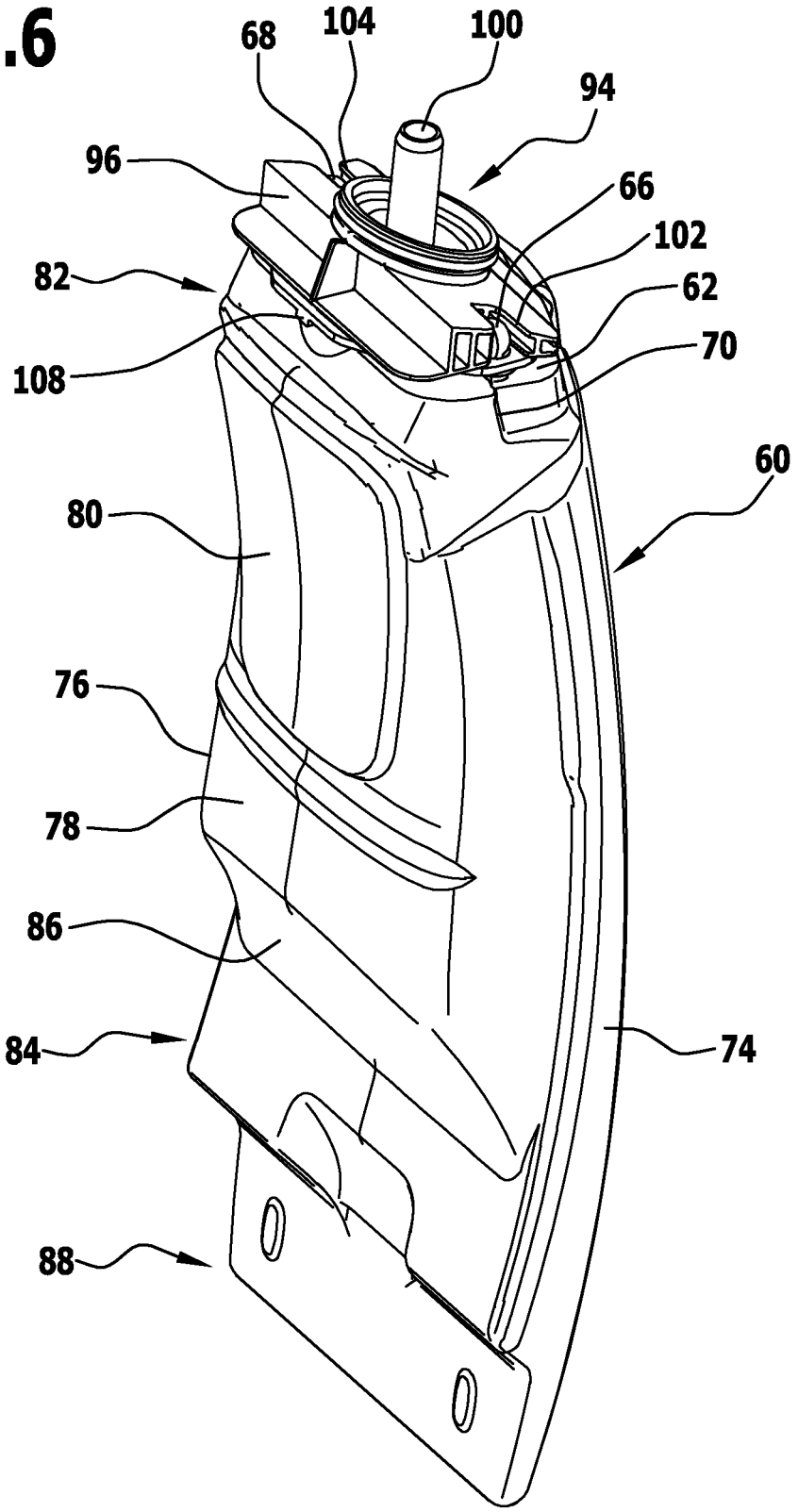
FIG. 6: shows a perspective representation of the dirty liquid tank of the hard surface cleaning appliance from FIG. 1 together with a filling device.
Figure 7:
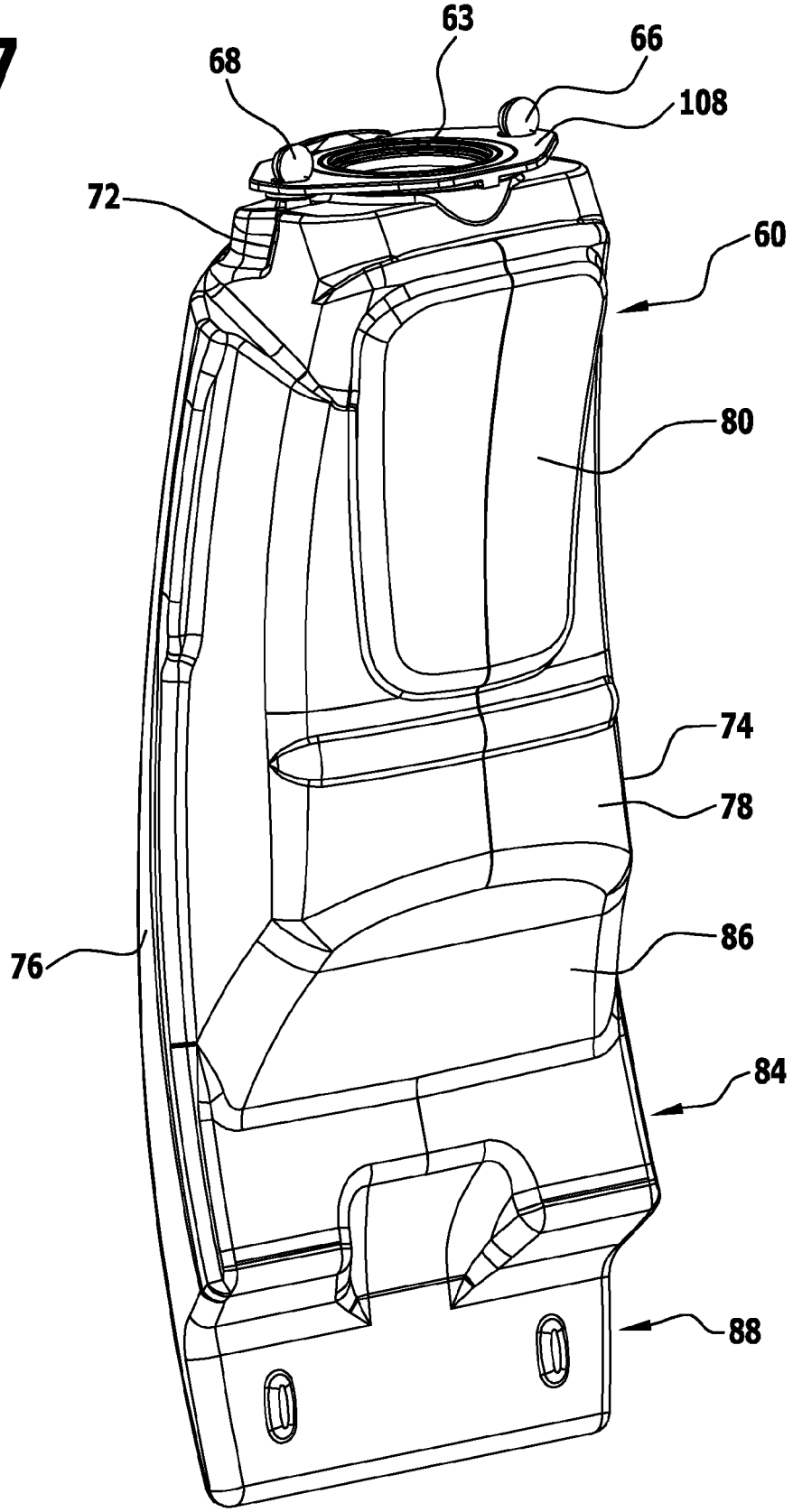
FIG. 7: shows a perspective representation of the dirty liquid tank from FIG. 1 without filling device.

The hard surface cleaning appliance 10 comprises a base part 12 which is shown schematically, in particular, in FIG. 5. The base part 12 surrounds a suction unit 14 with a suction turbine 16 which is set in rotation by an electric motor 18. Air can be drawn in by the suction turbine 16 via an arcuately curved turbine inlet line 20. The turbine inlet line 20 runs through a grip 22 of the base part 12. The grip 22 can be grasped by the user.

In addition to the suction unit 14, the base part 12 accommodates a rechargeable battery 24 and control electronics 26.

At a distance from the grip 22, the base part 12 forms a tank accommodating compartment 30 which is essentially configured in the manner of a tub with a rear wall 32 and a first side wall 34 and a second side wall 36. Adjoining the rear wall 32 in a lower area of the tank accommodating compartment 30 is a supporting area 38, which is formed by two supporting elements protruding from the rear wall 32, only one supporting element 40 of which is recognizable in the drawings, and by two gripper arms 42, 44 engaging around the supporting element.

The rear wall 32 has an upper wall section 46 extending substantially vertically, an adjoining middle wall section 48 aligned at an incline to the vertical and a lower wall section 50 of stepped configuration. In the upper wall section 46, the rear wall 32 has a first through-opening 52 via which the tank accommodating compartment 30 is connected to a grip opening 54 arranged between the grip 22 and the rear wall 32. When grasping the grip 22, the user can reach through the grip opening 54 with his fingers.

In the middle wall section 48, the rear wall 32 has a second through-opening 56 through which a turbine outlet line 58 of the suction unit 14 runs. This will be clear from FIG. 5. Insertable in the tank accommodating compartment 30 is a dirty liquid tank 60 which, as required, can also be removed from the tank accommodating compartment 30 again. The dirty liquid tank 60 is accommodated by the tank accommodating compartment 30 in areas thereof with positive locking. On an upper side 62, the dirty liquid tank 60 has a filler neck 63 with a filler opening 64 which is arranged between a first guide pin 66 and a second guide pin 68. The two guide pins 66, 68 protrude in the vertical direction from the upper side 62 of the dirty liquid tank 60.

Adjacent the two guide pins 66, 68, the dirty liquid tank 60 forms two recesses 70, 72 which are arranged on narrow sides 74, 76, facing away from each other, of the dirty liquid tank 60.

On its rear side 78 facing the rear wall 32, the dirty liquid tank 60 has a projecting area 80 which extends into the first through-opening 52.

The projecting area 80 as well as the recesses 70, 72 and the guide pins 66, 68 are located in an upper tank section 82 of the dirty liquid tank 60. Adjoining the upper tank section 82 is a middle tank section 84 which has an inclined surface 86 which assumes a distance from the middle wall section 48 of the rear wall 32. This will be clear, in particular, from FIG. 2.

Figure 2:
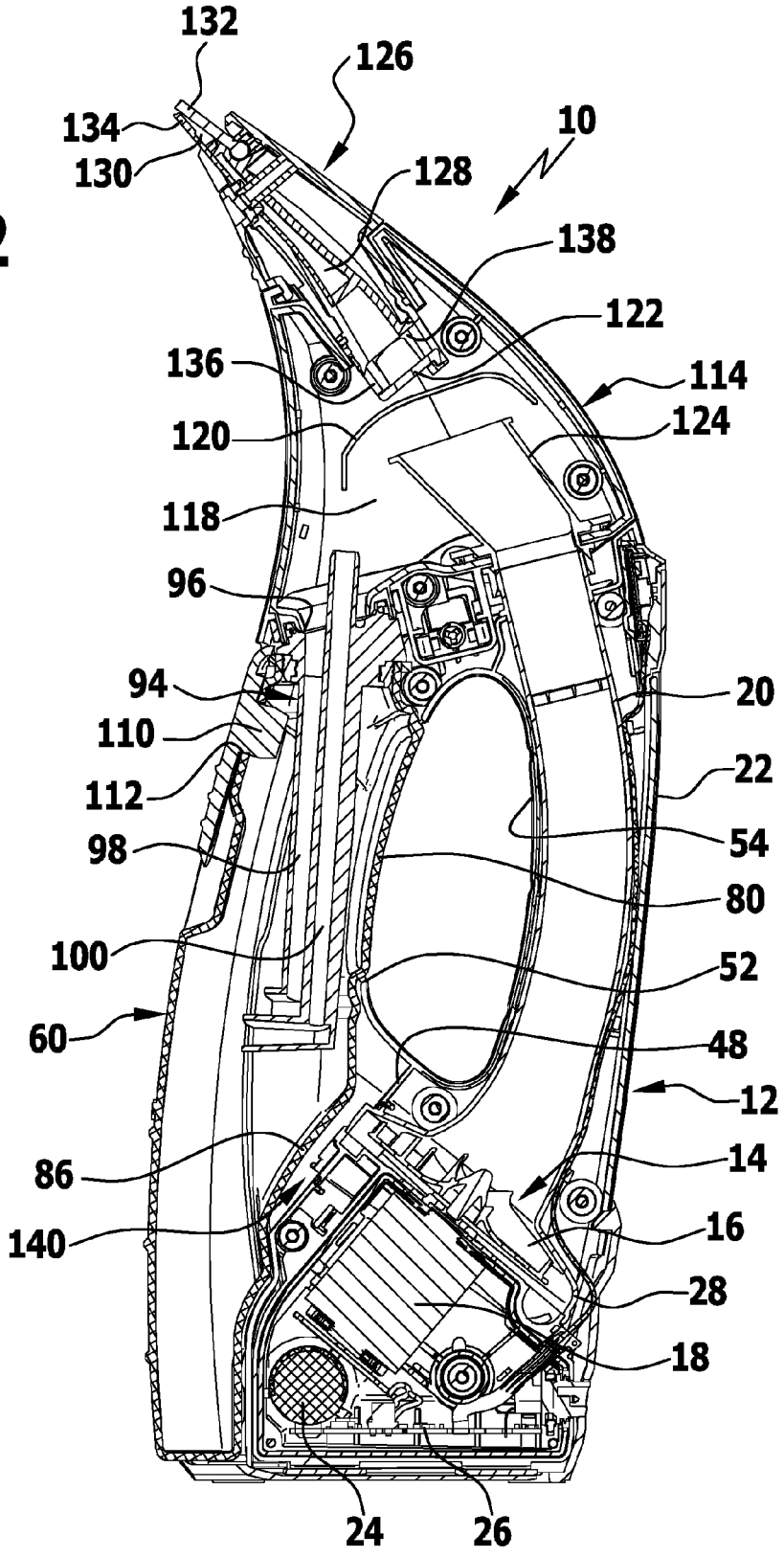
FIG. 2: shows a sectional view of the hard surface cleaning appliance from FIG. 1.
Figure 3:
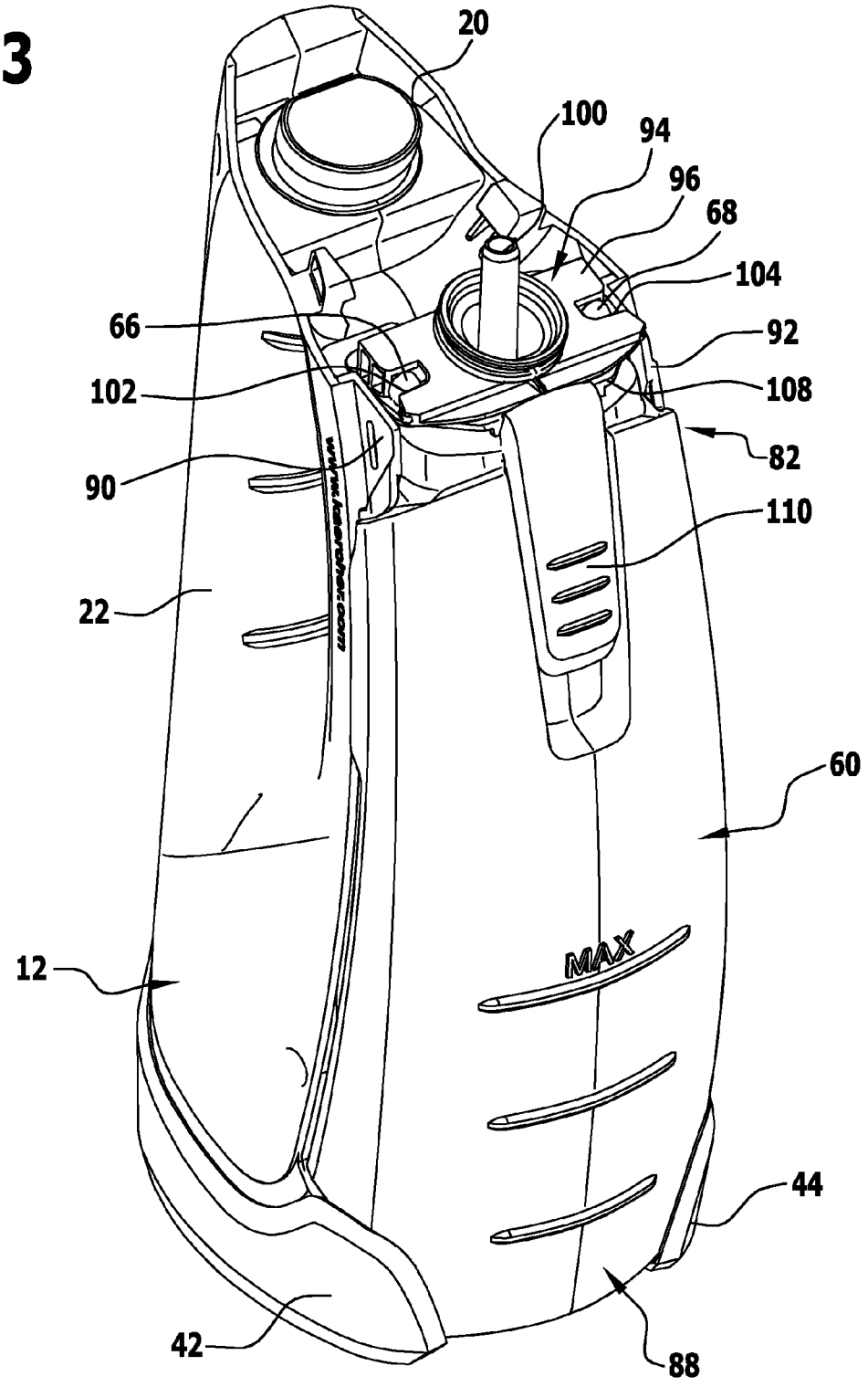
FIG. 3: shows a perspective representation of a base part of the hard surface cleaning appliance from FIG. 1 with a dirty liquid tank.

Adjoining the middle tank section 84 is a lower tank section 88 which, when the hard surface cleaning appliance 10 is vertically aligned, as shown in FIG. 2, can be inserted in the vertical direction into the supporting area 38. The upper tank section 82 can then be pivoted backwards about a horizontally aligned pivot axis, so that the projecting area 80 of the dirty liquid tank 60 enters the first through-opening 52 in the rear wall 32.

Figure 4:
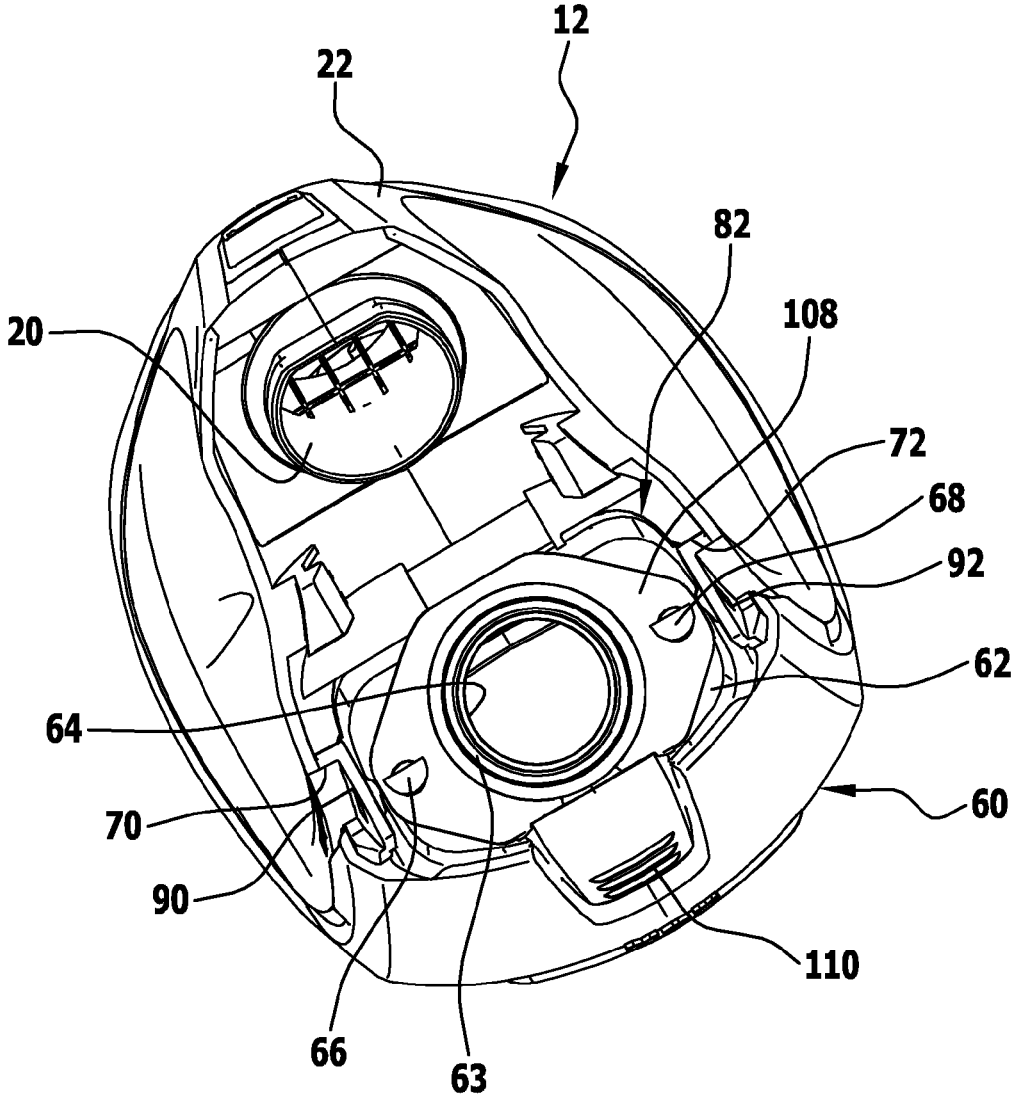
FIG. 4: shows a plan view of the base part from FIG. 3 with the dirty liquid tank.

At the level of the recesses 70, 72, elastically deformable holding elements in the form of holding arms 90, 92, which are L-shaped in a plan view, are formed on the side walls 34 and 36 of the tank accommodating compartment 30. The holding arms 90, 92 receive the upper tank section 82 in the area of the recesses 70, 72 between them and engage behind the recesses 70, 72. This will be clear, in particular, from FIG. 4.

The dirty liquid tank 60 can therefore be latched to the tank accommodating compartment 30 by means of the recesses 70, 72 and the holding arms 90, 92 of complementary configuration. The recesses 70, 72 form first latching elements which interact with the holding arms 90, 92 to establish a releasable latching connection. The holding arms 90, 92 form second latching elements which interact with the first latching elements.

To facilitate removal of the dirty liquid tank 60 from the tank accommodating compartment 30, the user can press the dirty liquid tank 60 in the projecting area 80 forwards through the first through-opening 52 in the rear wall 32, so that the elastically deformable holding arms 90, 92 release the recesses 70, 72 and the dirty liquid tank 60 can then be removed from the supporting area 38.

The dirty liquid tank 60 is filled via a filling device 94. The filling device 94 has a plate-shaped holding member 96 which is of wedge-shaped configuration and can be placed in the vertical direction on the upper side 62 of the dirty liquid tank 60. The holding member 96 carries on its underside a filling channel 98 which extends into the dirty liquid tank 60, and running parallel to the filling channel 98 is a venting channel 100, which also extends into the dirty liquid tank 60 and with an upper end section protrudes beyond the holding member 96. This will be clear, in particular, from FIG. 2.

The holding member 96 has two guide elements in the form of a first guide slot 102 and a second guide slot 104. When the holding member 96 is placed on the upper side 62 of the dirty liquid tank 60, the first guide slot 102 receives the first guide pin 66 and the second guide slot 104 receives the second guide pin 68. The two guide pins 66, 68 form in combination with the two guide slots 102, 104 guide elements engaging each other in the vertical direction, which facilitate the positioning of the holding member 96 on the upper side 62 of the dirty liquid tank 60.

As mentioned above, the dirty liquid tank 60 has a filler neck 63 on its upper side 62. A holding plate 108 can engage around the filler neck 63. The holding plate 108 is integrally connected to a closing plug 110 by means of which a drain opening 112 of the dirty liquid tank 60 can be closed. The dirty liquid tank 60 can be emptied via the drain opening 112. Therefore, for emptying the dirty liquid tank 60, the user has, on the one hand, the possibility of removing the complete dirty liquid tank 60 from the tank accommodating compartment 30 and then removing the filling device 94 from the dirty liquid tank 60, so that the dirty liquid tank 60 can be emptied via the filler opening 64, and, on the other hand, the user has the possibility of leaving the dirty liquid tank 60 in the tank accommodating compartment 30 and, for emptying purposes, only pulling the closing plug 110 out of the drain opening 112. During this, the closing plug 110 is held captively on the dirty liquid tank 60 by means of the holding plate 108. After the dirty liquid tank 60 has been emptied, the user can insert the closing plug 110 into the drain opening 112 again and thereby close it tight.

Adjoining the base part 12 and the dirty liquid tank 60 at the top is a separation part 114 which is releasably connected by a latching connection to the base part 12. Push buttons are arranged on the outside of the separation part 114 for releasing the latching connection. Only one push button 116 is recognizable in the drawings. A further push button is arranged on the opposite side of the separation part 114.

The separation part 114 forms a separation chamber 118 in which a separation device is arranged. The separation device is formed by an impact wall 120 and an impact plate 122 explained in more detail hereinbelow. The impact wall 120 is arcuately curved and covers a mouth area of a pipe section 124 which is arranged in the separation chamber 118 and to which the turbine inlet line 20 is connected.

Adjoining the separation part 114 at the top is a suction nozzle 126 comprising a suction line 128. The suction line 128 runs from a suction opening 130 at which a first drawing-off lip 132 and a second drawing-off lip 134 are arranged. With an end section facing away from the drawing-off lips 132, 134, the suction line 128 extends into the separation chamber 118. At its end extending into the separation chamber 118, the suction line 128 forms a plurality of holding webs 136 to which the impact plate 122 is fixed and which define suction outlets 138 between them.

The separation chamber 118 can be subjected to negative pressure by the suction unit 14. For this purpose, the suction unit 14 is in flow connection via the turbine inlet line 20 and the pipe section 124 with the separation chamber 118. Owing to the separation chamber 118 being subjected to negative pressure, a suction flow starting from the suction opening 130 via the suction line 128 is formed and runs from the suction opening 130 to the suction unit 14.

As mentioned above, the portable hard surface cleaning appliance 10 can be moved along a hard surface, in particular, along a window pane, by the user. This makes it possible to draw off liquid from the hard surface with the first drawing-off lip 132 and the second drawing-off lip 134. During this, the liquid collects at the suction opening 130 and is sucked together with suction air via the suction line 128 into the separation chamber 118. In the separation chamber 118, the liquid-air mixture first strikes the impact plate 122 at which some of the liquid that is carried along is separated. A further separation of liquid takes place at the impact wall 120 arranged at a distance from the impact plate 122. The sucked-in air can then pass to the suction turbine 16 of the suction unit 14 via the pipe section 124 and the turbine inlet line 20. From the suction turbine 16, the sucked-in air is conducted via the turbine outlet line 58 into an air outlet space 140 arranged between the middle wall section 48 of the rear wall 32 of the tank accommodating compartment 30 and the middle tank section 84 of the dirty liquid tank 60. From the air outlet space 140, the sucked-in air can then be discharged via gap-shaped spaces 142 to the environment. The spaces 142 extend in the middle tank section 84 between the side walls 34, 36 of the tank accommodating compartment 30 and the narrow sides 74, 76 of the dirty liquid tank 60.

The dirty liquid tank 60 therefore forms in combination with the tank accommodating compartment 32 a flow labyrinth for the suction air discharged by the suction turbine 16 to the environment. This results in a considerable reduction in the noise generation of the portable hard surface cleaning appliance 10.

The liquid separated off in the separation chamber 118 passes via the filling channel 98 into the dirty liquid tank 60, and, at the same time, air located in the dirty liquid tank 60 can be discharged via the venting channel 100 to the separation chamber 118 and sucked off from it via the pipe section 124 and the turbine inlet line 20.

The invention claimed is:

1. A portable hard surface cleaning appliance for drawing off and sucking up liquid from a hard surface, in particular, from a window pane, comprising a suction nozzle with a suction opening on which at least one drawing-off lip is arranged, a suction unit which is in flow connection with the suction nozzle for sucking up a liquid-air mixture from the suction opening, a separation chamber which is positioned in the flow path between the suction nozzle and the suction unit and in which a separation device is arranged for separating liquid from the liquid-air mixture, and a tank accommodating compartment in which a dirty liquid tank for receiving the liquid separated off in the separation chamber is releasably held, the tank accommodating compartment comprising at least one supporting element and at least one holding element, the at least one supporting element engaging under a lower tank section of the dirty liquid tank and the at least one holding element being releasably connectable to an upper tank section of the dirty liquid tank, wherein the hard surface cleaning appliance comprises two holding elements which receive between them the upper tank section of the dirty liquid tank.

2. The portable hard surface cleaning appliance in accordance with claim 1, wherein the portable hard surface cleaning appliance comprises a base part in which the suction unit is arranged.

3. The portable hard surface cleaning appliance in accordance with claim 2, wherein the base part forms the tank accommodating compartment.

4. The portable hard surface cleaning appliance in accordance with claim 1, wherein the portable hard surface cleaning appliance comprises a separation part in which the separation chamber is arranged.

5. The portable hard surface cleaning appliance in accordance with claim 4, wherein the portable hard surface cleaning appliance comprises a base part in which the suction unit is arranged, and wherein the separation part is releasably connected to the base part.

6. The portable hard surface cleaning appliance in accordance with claim 4, wherein the suction nozzle is releasably connected to the separation part.

7. The portable hard surface cleaning appliance in accordance with claim 1, wherein when the hard surface cleaning appliance is vertically aligned, the lower tank section of the dirty liquid tank is insertable in the vertical direction into a supporting area of the tank accommodating compartment, and by pivoting the dirty liquid tank about a horizontal pivot axis, the upper tank section is then pivotable into a holding position in which the upper tank section is positioned between the two holding elements.

8. The portable hard surface cleaning appliance in accordance with claim 1, wherein the upper tank section is releasably latchable to the two holding elements.

9. The portable hard surface cleaning appliance in accordance with claim 8, wherein first latching elements are arranged on the upper tank section on outer sides of the dirty liquid tank that face away from each other and second latching elements arranged on the holding elements are engageable behind the first latching elements.

10. The portable hard surface cleaning appliance in accordance with claim 1, wherein the dirty liquid tank protrudes at the sides from the tank accommodating compartment below the holding elements.

11. The portable hard surface cleaning appliance in accordance with claim 1, wherein the tank accommodating compartment has a rear wall against which the dirty liquid tank lies in areas thereof and which has at least one through-opening.

12. The portable hard surface cleaning appliance in accordance with claim 11, wherein the dirty liquid tank extends into at least one through-opening.

13. The portable hard surface cleaning appliance in accordance with claim 11, wherein the hard surface cleaning appliance comprises a grip, and arranged between the grip and the rear wall of the tank accommodating compartment is a grip opening into which at least one through-opening of the rear wall opens.

14. The portable hard surface cleaning appliance in accordance with claim 11, wherein at least one through-opening extends into an area which is arranged between the two holding elements.

15. The portable hard surface cleaning appliance in accordance with claim 1, wherein the hard surface cleaning appliance comprises a filling device for filling the dirty liquid tank with the liquid separated off in the separation chamber, the filling device having a holding member which is positionable on the upper side of the dirty liquid tank and on which is held a filling channel which extends into the dirty liquid tank via a filler opening of the dirty liquid tank, the holding member being clampable between the separation chamber and the dirty liquid tank.

16. The portable hard surface cleaning appliance in accordance with claim 15, wherein guide elements insertable in each other in the vertical direction are arranged on the upper side of the dirty liquid tank and on the holding member.

17. The portable hard surface cleaning appliance in accordance with claim 16, wherein the guide elements arranged on the upper side of the dirty liquid tank are configured as guide pins which are arranged at both sides of the filler opening.

18. The portable hard surface cleaning appliance in accordance with claim 17, wherein the guide elements arranged on the holding member are configured as guide slots which receive the guide pins.

19. The portable hard surface cleaning appliance in accordance with claim 15, wherein the dirty liquid tank comprises a collar which is surrounded by a holding plate, and a closing plug for closing a drain opening of the dirty liquid tank is fixed to the holding plate.

20. The portable hard surface cleaning appliance in accordance with claim 19, wherein the holding plate is clamped between the holding member and the dirty liquid tank.

21. The portable hard surface cleaning appliance in accordance with claim 15, wherein the holding member is of plate-shaped configuration.

22. The portable hard surface cleaning appliance in accordance with claim 15, wherein the holding member is of wedge-shaped configuration.

* * * * *